US005332119A

United States Patent [19]

Davis

[11] Patent Number: 5,332,119

[45] Date of Patent: Jul. 26, 1994

[54] PERSONAL DEFENSE APPARATUS AND COMBINED EXERCISE WEIGHT

[76] Inventor: Richard C. Davis, 3384 Tarpon Woods Blvd., Palm Harbor, Fla. 34685

[21] Appl. No.: 37,827

[22] Filed: Mar. 24, 1993

[51] Int. Cl.[5] ..... B67D 5/00

[52] U.S. Cl. ..... 222/78; 222/192; 482/108

[58] Field of Search ..... 222/78, 175, 192; D9/378; 42/1.04; 476/106–108

[56] References Cited

U.S. PATENT DOCUMENTS

| | | | |
|---|---|---|---|
| 2,634,535 | 4/1953 | Borders | 42/1 |
| 3,432,077 | 3/1969 | Voll | 222/78 |
| 3,516,424 | 6/1970 | Eagle | 222/192 X |
| 3,635,374 | 1/1972 | Anketell | 222/78 |
| 4,218,057 | 8/1980 | Wilson | 272/117 |
| 4,229,015 | 10/1980 | Ramsey | 222/552 X |
| 4,351,526 | 9/1982 | Schwartz | 272/122 |
| 4,463,879 | 8/1984 | Des Voignes | 222/175. |
| 4,575,074 | 3/1986 | Damratoski | 272/119 |
| 4,627,618 | 12/1986 | Schwartz | 272/122 |
| 4,702,473 | 10/1987 | Paquette | 222/175 X |
| 4,720,098 | 1/1988 | Gordon | 272/122 |
| 4,890,767 | 1/1990 | Burlison | 222/78 |
| 5,086,377 | 2/1992 | Roberts | 362/102 |
| 5,111,968 | 5/1992 | Wilkerson | 222/175 X |

*Primary Examiner*—Andres Kashnikow
*Assistant Examiner*—Kenneth DeRosa
*Attorney, Agent, or Firm*—Griffin Butler Whisenhunt & Kurtossy

[57] ABSTRACT

A personal defense apparatus (18) is in the form of an exercise-weight handguard and includes a trigger (24) extending between a handgrip (68) of an exercising weight (44) on which the personal defense apparatus is mounted and a nozzle (82) of a canister (28) contained in a housing (36) of the personal defense apparatus for being manipulated by a finger or thumb of a hand gripping the handgrip to activate the nozzle for allowing defense fluid to escape from the canister.

9 Claims, 3 Drawing Sheets

FIG. 4
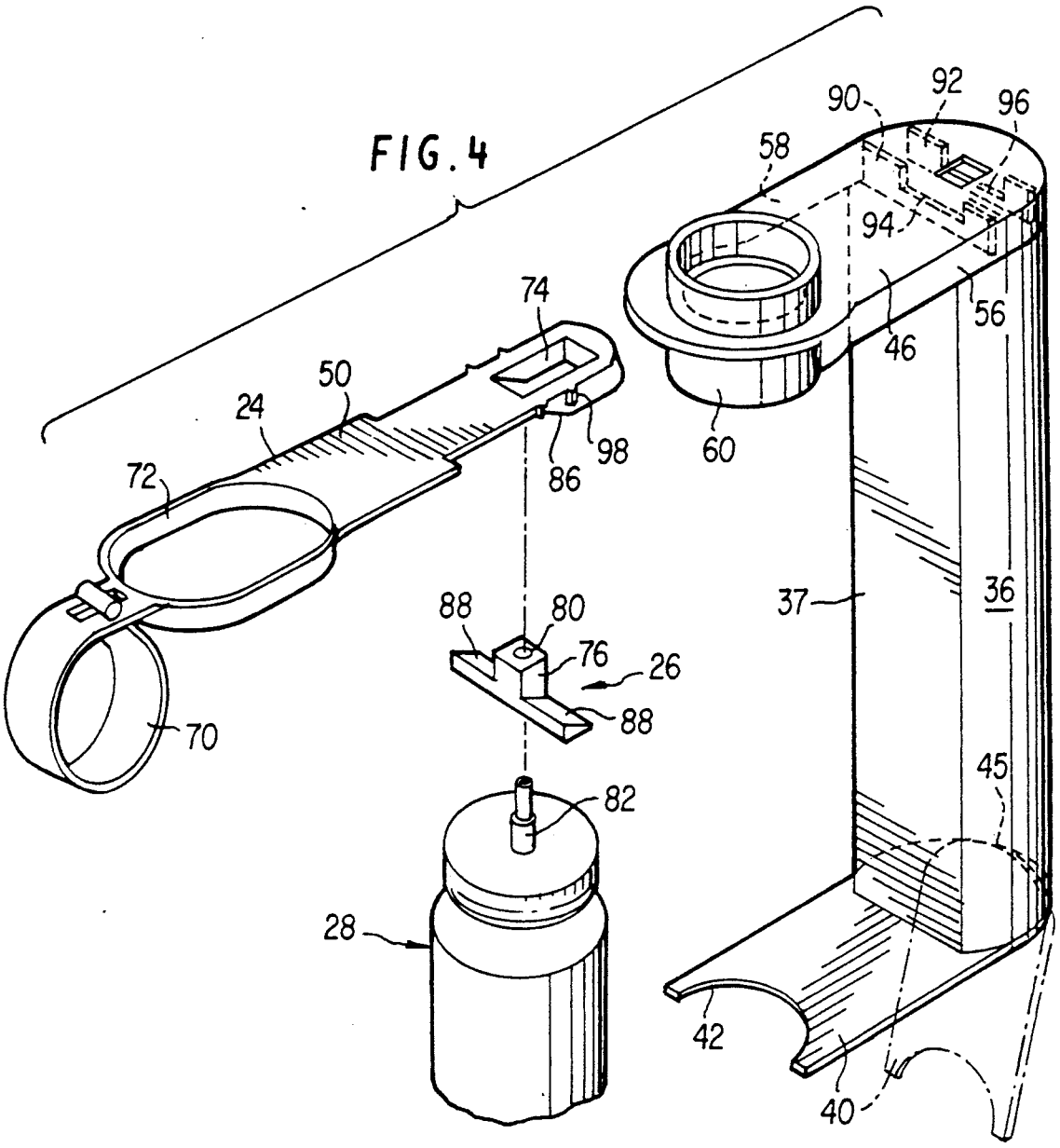
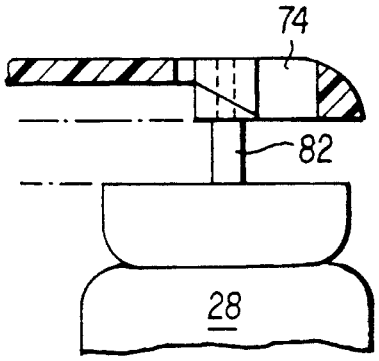
FIG. 5
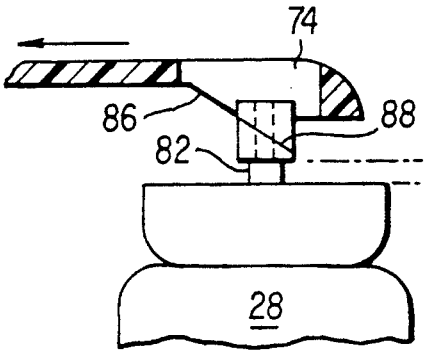
FIG. 6

PERSONAL DEFENSE APPARATUS AND COMBINED EXERCISE WEIGHT

BACKGROUND OF THE INVENTION

This invention relates generally to the art of personal defense apparatus and more specifically to such apparatus employing pressurized defense fluids.

In recent years, many individuals have begun carrying pressurized defense fluid canisters for spraying defense fluids on would-be attackers or menacing animals. Such defense fluids include MACE, other tear gases, noxious substances, pepper compounds, paint, dye and/or other coloring.

Also in recent years, many joggers and walkers have begun carrying barbell-type exercising weights in their hands while jogging or walking. Presumably these exercising weights enhance the exercising value of such activities by applying increased loads to certain muscles.

Those people who like to exercise by walking or jogging often prefer to use outdoor routes along paths, sidewalks, and even streets. In this regard, indoor facilities are not always available and many people simply prefer the outdoors. However, many outdoor exercisers, especially women, have encountered would-be "muggers".

Although it would be possible for exercisers to carry pressurized-defense-fluid defense-apparatus, this is not very practical, because exercisers are usually clad in garments which do not lend themselves well to carrying excess items. Similarly, even if defense apparatus were carried by exercisers, they could often not be quickly accessed since exercisers' hands are often occupied holding exercise weights.

Thus, it is an object of this invention to provide a personal defense apparatus which can be easily carried and used by outdoor exercisers, even while they are holding weights in their hands.

It is a further object of this invention to provide a personal defense apparatus for exercisers which is handy for them to use but yet which is not readily visible to would-be attackers. Along the same line it is an object of this invention to provide a personal defense apparatus which can be employed with an element of surprise, catching would-be attackers off guard.

It is a further object of this invention to provide a personal defense apparatus which is relatively uncomplicated and relatively inexpensive, but yet which is highly effective and easy to actuate.

SUMMARY

According to principles of this invention, a personal defense apparatus forms a handguard for a handgrip of an exercise weight and includes a trigger extending between the handgrip and a nozzle of a canister contained in a housing of the personal defense apparatus for being manipulated by a thumb or finger of a hand gripping the handgrip to activate the nozzle for spraying defense fluid from the canister.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 4 is a exploded isometric view of an inner-housing structure, trigger, and nozzle follower of this invention along with a canister;

FIG. 5 is a simplified, partially cutaway, segmented view of a portion of the trigger in an inactive position, the nozzle follower and a nozzle portion of the canister; and FIG. 6 is a view similar to FIG. 5, but with the trigger in an activated position.

DESCRIPTION OF A PREFERRED EMBODIMENT

Figure 1:
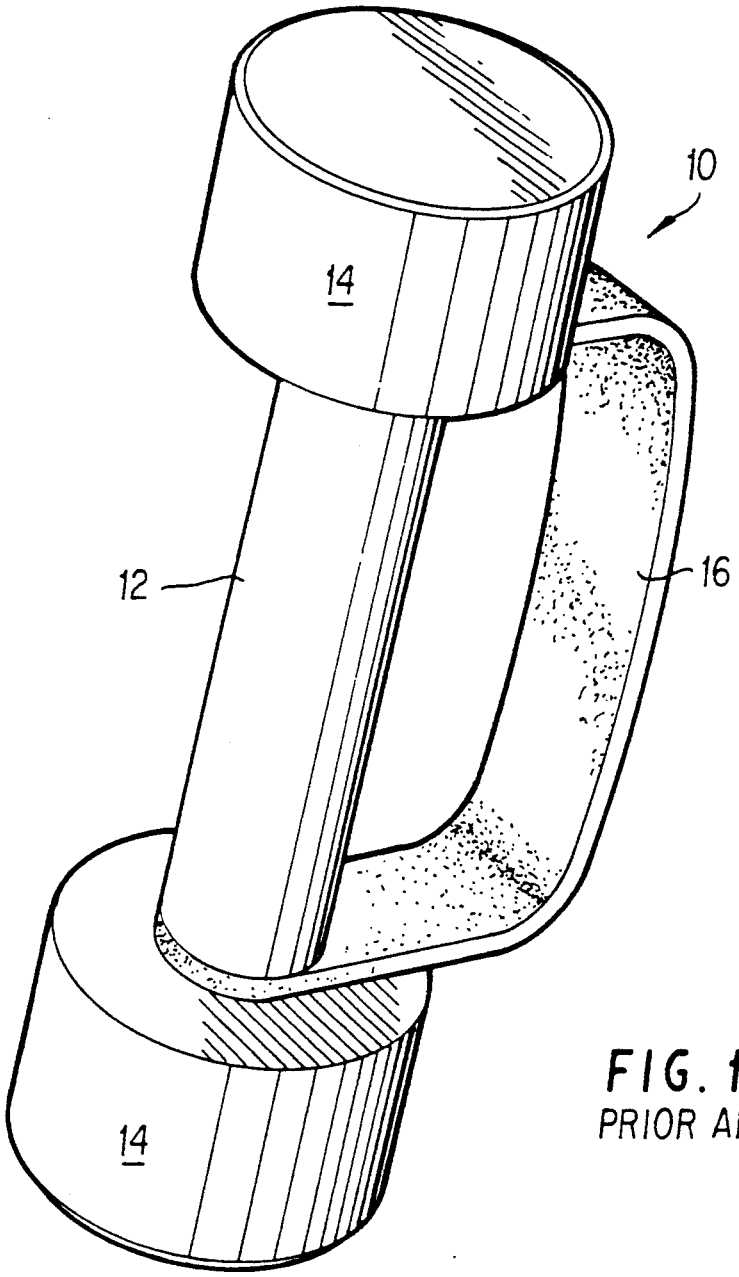
FIG. 1 PRIOR ART
FIG. 1 is an isometric view of an exercise weight of a type often used by joggers.

A prior-art barbell-type exercising weight 10 shown in FIG. 1 comprises a handpost 12 having weights 14 screwed to opposite ends thereof and a relatively flexible handguard 16 for extending about a hand gripping the handpost 12 to prevent the exercising weight 10 from easily falling from the hand. In this regard, in many cases the handguard 16 has openings at the ends thereof through which threaded shafts of the handpost 12 extend to be clamped between the weights 14 and the handpost 12 or a resilient handgrip sleeve 68 (FIG. 2) when the weights are screwed onto the handpost. Different size weights 14 can be screwed to the handpost or light plastic nuts can be screwed to the handpost 12 instead of weights, the handpost 12 itself also serving as a weight.

Looking now at a personal defense apparatus 18 of this invention (FIG. 2) which is in the form of a handguard, this apparatus basically comprises an inner-housing structure 20, an outer-housing structure 22, a trigger 24, a nozzle follower 26, and a canister 28 of a pressurized defense fluid. The inner and outer-housing structures 20 and 22 form a trigger attaching assembly 30 and a non-trigger attaching assembly 32 at opposite ends of a cylindrical housing 34.

Looking first at the inner-housing structure 20 in more detail, this structure is formed of a hard, rather rigid, plastic with a housing portion 36 thereof being cylindrically shaped, although it has a flat side 37 facing a weighted hand post 44 to form a housing cavity 38 for containing the canister 28. At the non-trigger attaching assembly end thereof there is a rotatable flange 40 with a half-circle cutout 42 at an outer end thereof for fitting on and engaging an outer surface of the weighted handpost 44. However, since the half-circle cutout 42 does not form a complete circle, the flange 40 does not attach the personal defense apparatus 18 to the weighted handpost 44. The flange 40 is attached to the housing portion 36 by means of a hinge portion 45 which is molded together with the flange 40 and the housing portion 36. The flange also includes an integral latch 47 for retaining it in a closed position when it is hinged thereto about hinge portion 45.

At the trigger-attaching assembly 30 end of the housing portion 36 of the inner-housing structure 20, a trigger-guide flange 46 forms a flat trigger slot 48 for containing a flat portion 50 of the trigger 24. That is, the trigger-guide flange 46 is formed of an upper wall 52, a lower wall 54, and side walls 56 and 58, all of which define the trigger slot 48. The upper wall 52 extends outwardly further than the lower wall 54 and defines a grommet, or collar, 60 which receives the weighted handpost 44 in a cavity thereof. The relative functions of the upper wall 57 and lower wall 54 may be reversed in other embodiments; that is, so that the collar 60 protrudes from the lower wall instead of the upper wall. In any case, the collar 60 completely encircles the weighted handpost 44 so as to mount the personal defense apparatus 18 on the weighted handpost 44.

The outer-housing structure 22, which is of a foam rubber material, is basically tubularly shaped and completely encloses the inner-housing structure 20. In addition, the outer-housing structure 22 extends outwardly beyond the half-circle cutout 42 of the non-trigger flange 40 to define an opening 62 therein for receiving the other end of the weighted handpost 44 and thereby also mounting the personal defense apparatus 18 on the weighted handpost 44. Thus, the personal defense apparatus 18 is more rigidly attached to the weighted handpost 44 at the trigger end than at the non-trigger end, because at the trigger end it is attached by means of the more rigid inner-housing structure 20 while at the non-trigger end it is only attached thereto by the more flexible and resilient outer-housing structure 22.

Figure 2:
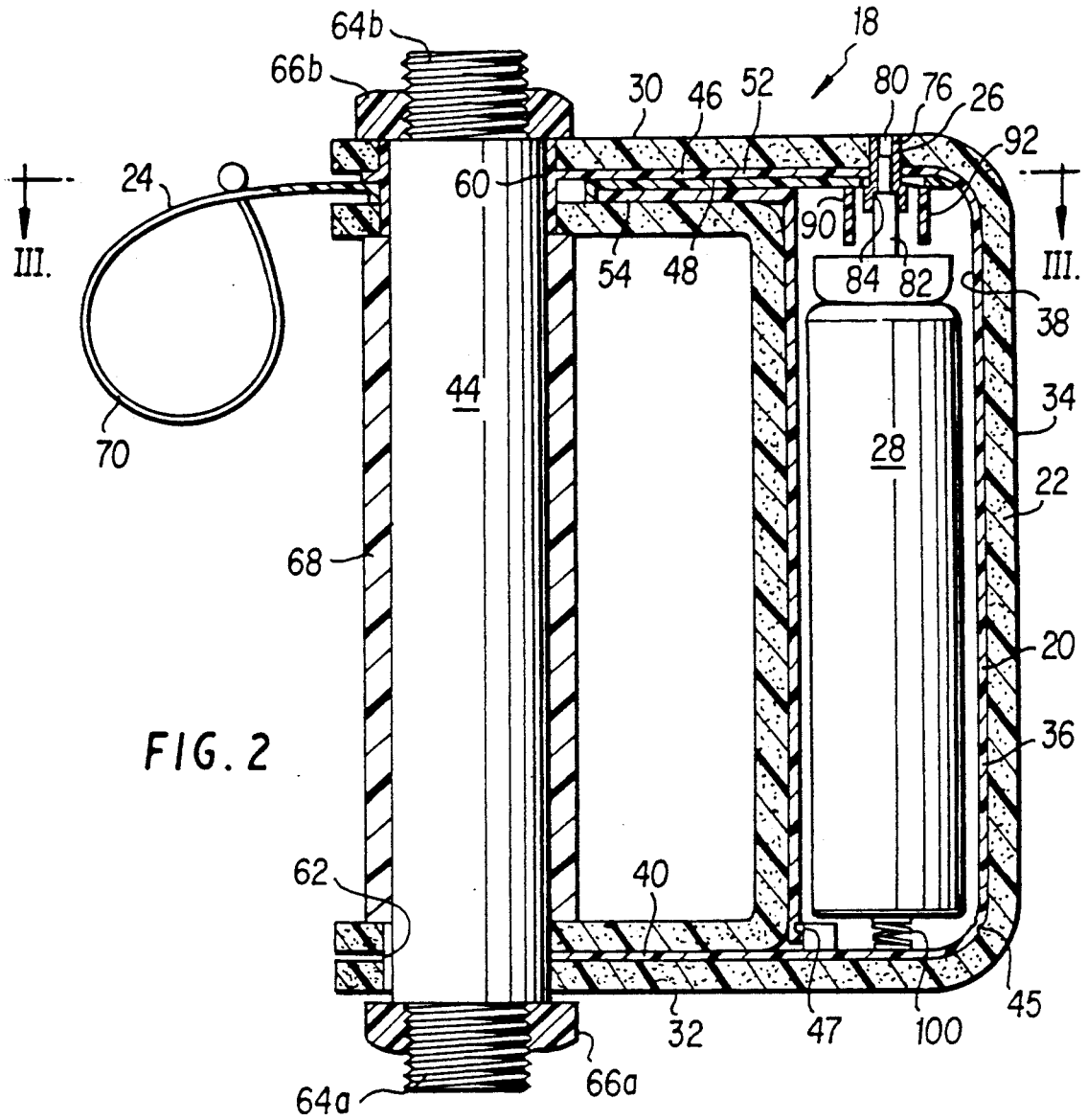
FIG. 2 is a partially cross-sectional view of a personal defense apparatus of this invention mounted on a handpost of an exercise weight including a canister of pressurized defense fluid.

Looking more closely at the manner in which the personal defense apparatus 18 is attached to the weighted handpost 44, the weighted handpost 44 includes threaded studs 64*a*, 64*b* at opposite ends thereof which respectively engage internal threads of plastic nuts 66*a*, 66*b* or female threads of weights 14 of the type depicted in FIG. 1. Also, the weighted handpost 44 has a resilient handgrip sleeve 68 of a soft foam rubber material surrounding it. As can be seen in FIG. 2, the outer- and inner-housing structures 22 and 20 are clamped between the plastic nuts 66*a* and *b* and the handgrip sleeve 68 to hold the personal defense apparatus 18 in place for forming a handguard for a hand gripping the resilient handgrip sleeve 68.

Looking in more detail at the trigger 24, this member is formed of a rather resilient nylon so as to be tough, relatively hard, but yet flexible. The trigger has a loop 70 at its outer end which is engageable by a finger, such as the thumb, of a hand gripping the handgrip sleeve 68. Also, the trigger defines an elongated opening 72 for accommodating the weighted handpost 44 and the collar 60 surrounding the handpost in such a manner that the trigger can slide longitudinally on the collar 60. An inner end of the trigger 24 forms an elongated rectangular slot 74 for receiving a nozzle post 76 of the independent nozzle follower 26. Thus, again, the trigger 24 is allowed to slide longitudinally along the nozzle post 76. The nozzle post 76 has a nozzle opening 80 therein for receiving a nozzle 82 of the canister 28. It can be seen in FIG. 2 that the nozzle opening 80 of the nozzle post 76 is larger at a bottom end than at the top so that the nozzle 82 can extend into the bottom of the nozzle opening 80, but a wall forming the nozzle opening 80 impinges on a top of the nozzle 82 at a shoulder 84. The trigger 24 has tapered trigger cam surfaces 86 which cooperate with tapered follower cam surfaces 88 on the trigger follower 26 whereby, when one pulls on the trigger at the loop 70, the trigger cam surfaces 86 cooperate with the follower cam surfaces 88 to drive the nozzle follower 26 downwardly, thereby driving the nozzle 82 downwardly and activating a valve therein to allow escape of the pressurized defense fluid within the canister 28.

Figure 3:
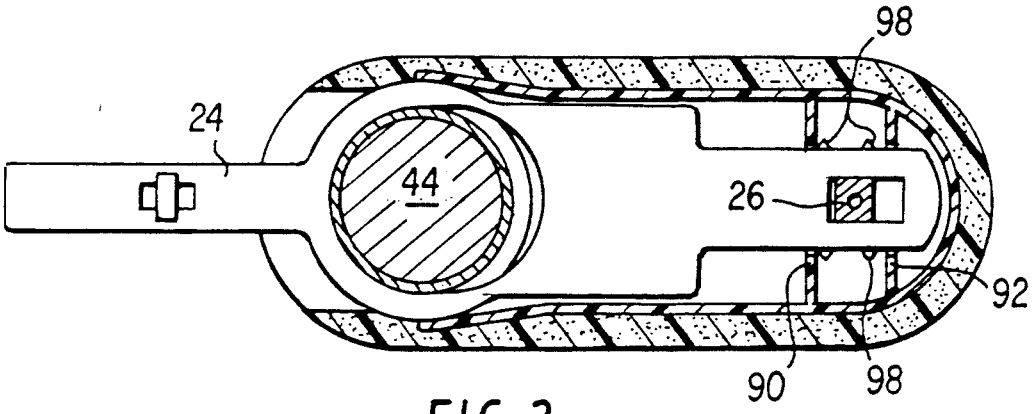
FIG. 3 is a cross-sectional view taken on line III—III in FIG. 2.

It should be noted that the inner-housing structure 20 includes two ribs 90 and 92 with slots 94 and 96 therein for receiving and guiding the trigger 24 and for supporting the trigger-guide flange 46 relative to the housing portion 36. In addition, the trigger 24 has latch protrusions 98 (FIG. 3) on side edges thereof which cooperate with edges of the ribs 90 and 92 to prevent unintentional activation of the personal defense apparatus 18 and to ensure that once the personal defense apparatus 18 is actuated the valve of the nozzle 82 remains open until all contents of the canister 28 are evacuated.

As mentioned above, the inner-housing structure 20 is of a rather hard, although somewhat flexible, plastic while the outer-housing structure 22 is of a tough resilient foam material. The nozzle follower 26 is of a material similar to that of the inner-housing structure 20. The personal defense apparatus 18 shown herein is constructed as a throw-away unit which must be totally replaced once the canister 28 has been discharged. However, it is possible to construct the apparatus so that the canister 28 can be replaced once it has been discharged.

The outer-housing structure 22 is basically a tube having holes for the weighted handpost 44 and the nozzle follower 26 blanked therein.

When assembling the apparatus, the trigger 24 is first slid into position by feeding it along the trigger slot 48 which is formed by the walls 52, 54, 56 and 58 respectively, until its latch protrusions 98 nest between the slots 94 and 96. The trigger follower 26 is placed onto the nozzle 82 of the pressurized container 28 and the assembly is slid into position in the housing cavity 38 of the housing portion 36 until the trigger follower 26 abuts, or almost abuts, the trigger 24 and is positioned between the ribs 90 and 92. The spring 100 is then attached to the rotatable flange 40 which is folded over and latched into position by the latch 47, thereby securing the container 28 into the housing 36. In this regard, the spring 100 mounted on an inner surface of the rotatable non-trigger flange 40 in one embodiment applies longitudinal pressure to a bottom end of the canister to drive the canister toward the trigger follower 26. The spring 100 compensates for tolerances of housing and canister sizes to ensure that the nozzle 82 is actuated by the trigger follower 26. The inner-housing structure 20 is then threaded into the outer-housing structure 22 and the trigger-attaching and non-trigger attaching assemblies 30 and 32 are attached to the weighted handpost 44 by means of the plastic nuts 66*a* and *b* and the handgrip sleeve.

Looking now at operation of the personal defense apparatus 18, after it is combined with the weighted handpost 44, a jogger, for example, grips the weighted handpost 44 about the resilient handgrip sleeve 68 with his hand inserted between the resilient handgrip sleeve 68 and the cylindrical housing 34 of the personal defense apparatus 18. Simultaneously therewith, the jogger inserts his thumb, or some other finger, in the loop 70 of the trigger 24 so as to be ready to pull the trigger 24 and thereby activate the valve in the nozzle 82 of the canister 28. When the jogger inserts his hand between the resilient handgrip sleeve 68 and the cylindrical housing 34, the cylindrical housing 34 is allowed to flex outwardly by the foam-rubber outer-housing structure 22 which forms the opening 62 surrounding the non-trigger end of the weighted handpost 44.

In any event, should the jogger encounter an attacker, he merely manipulates the exercise device to direct the nozzle opening 80 of the nozzle follower 26 at the attackers face and pulls the trigger 24 downwardly and/or outwardly to activate the valve at the nozzle 82. As this is done, movement of the trigger is resisted by friction between the latch protrusions 98 and the ribs 90 and 92, but once the trigger has been pulled longitudinally, it is not allowed to move backwardly because of friction between the latch protrusions 98 and the ribs 90 and 92. Thus, the trigger cam surfaces 86 continually press downwardly on the follower cam surfaces 88 and discharge the entire pressurized defense fluid at the attacker.

A benefit of this invention is that the personal defense apparatus 18 serves as an excellent handguard for an exercising weight when it is not being used as a defense weapon. That is, it is light and easy to carry, because not only does it not get in the way but it serves a beneficial purpose as well.

Also, a benefit of this invention is that the personal defense apparatus 18 is readily accessible when one is attacked so that the person attacked does not need to make suspicious movements before the personal defense apparatus can be activated.

It is beneficial to have a flat surface 37 on the rigid housing portion 36 because this is comfortable to the back of a hand gripping the hand grip sleeve 68, whereas if the housing portion 36 is perfectly round, it hurts the back of the hand.

Yet another benefit of this invention is that it is relatively uncomplicated and therefore can be manufactured in an inexpensive manner.

While the invention has been particularly shown and described with reference to a preferred embodiment, it will be understood by those of ordinary skill in the art that various changes in form and detail may be made therein without departing from the spirit and scope of the invention.

For example, it would be possible to attach the personal defense apparatus to an exercising weight in another manner. Also, it would be possible to configure an exercising weight in another manner than that depicted in this invention. Further, one could form the trigger in another manner than that described herein. Also, the pressurized defense fluid could be a dye, noxious substance, a fluid for activating a noise maker, or the like.

The embodiments of the invention in which an exclusive property or privilege are claimed are defined as follows:

1. A combination exercise weight and personal defense apparatus comprising:

an exercise weight having a handgrip to be gripped by one using the exercise weight;

a personal defense apparatus comprising:

an attaching means for attaching said personal defense apparatus to said exercise weight;

a housing for containing a canister of a pressurized defense fluid, but for defining an opening for allowing said defense fluid to escape from a nozzle of said canister;

a trigger means for being manipulated to activate said nozzle for allowing defense fluid to escape from said canister;

wherein said personal defense apparatus is formed as a handguard, for extending about a hand gripping said handgrip.

2. An exercise weight apparatus as in claim 1 wherein said tripper means extends between said handgrip of said exercising weight and a nozzle of said canister contained in said housing for being manipulated by the hand gripping said handgrip to thereby activate said nozzle.

3. An exercise weight apparatus as in claim 2 wherein the trigger is an elongated flexible member which is activated by being pulled longitudinally.

4. An exercise weight apparatus as in claim 3 wherein is further included a trigger cam on said trigger and a follower cam mounted on said nozzle, said trigger cam and said follower cam cooperating with one another to move said nozzle when said trigger is pulled longitudinally.

5. An exercise weight apparatus as in claim 4 wherein said trigger includes a loop positioned adjacent said handgrip for receiving a finger of the hand gripping said handgrip.

6. An exercise weight apparatus as in claim 3 wherein said personal defense apparatus comprises an inner-housing structure of a relatively hard plastic and an outer-housing structure surrounding said inner-housing structure of a foam-type material.

7. An exercise weight apparatus as in claim 6 wherein said attaching means includes a means for attaching said personal defense apparatus to said exercising weight at two separate places, at one of said places, said attaching means is formed by said inner-housing structure whereas at the other attachment place, the attaching means is formed by said outer-housing structure.

8. An exercise weight apparatus as in claim 1 wherein said personal defense apparatus comprises an inner-housing structure of a relatively hard plastic and an outer-housing structure surrounding said inner-housing structure of a foam-type material.

9. An exercise weight apparatus as in claim 8 wherein said attaching means includes a means for attaching said personal defense apparatus to said exercising weight at two separate places, at one of said places, said attaching means is formed by said inner-housing structure whereas at the other attachment place, the attaching means is formed by said outer-housing structure.

* * * * *